US006823154B2

(12) United States Patent
Koga et al.

(10) Patent No.: US 6,823,154 B2
(45) Date of Patent: Nov. 23, 2004

(54) IMAGE FORMING APPARATUS

(75) Inventors: Hiroto Koga, Chiba (JP); Wataru Kawata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/375,091

(22) Filed: Feb. 28, 2003

(65) Prior Publication Data

US 2003/0170059 A1 Sep. 11, 2003

(30) Foreign Application Priority Data

Mar. 8, 2002 (JP) ..... 2002-064318

(51) Int. Cl.[7] ..... G03G 15/00

(52) U.S. Cl. ..... 399/110; 399/107; 399/361; 399/407; 355/46

(58) Field of Search ..... 399/107, 110, 399/361, 397, 401, 403, 407; 355/46; 101/117, 232

(56) References Cited

U.S. PATENT DOCUMENTS 5,164,769 A * 11/1992 Hashimoto et al. ..... 399/77
5,655,208 A * 8/1997 Sahay et al. ..... 399/397
6,145,826 A 11/2000 Kawata ..... 270/58.28
6,237,910 B1 5/2001 Kawata ..... 271/213
6,241,234 B1 6/2001 Saitoh et al. ..... 270/58.12
6,264,189 B1 7/2001 Kawata ..... 271/176
6,374,066 B1 * 4/2002 Smith et al. ..... 399/107
6,470,156 B1 * 10/2002 Sahay ..... 399/82
6,505,829 B2 1/2003 Kawata ..... 271/208

FOREIGN PATENT DOCUMENTS

JP 60-180894 9/1985
JP 60-191932 9/1985
JP 60-204564 10/1985

* cited by examiner

*Primary Examiner*—Andrew H. Hirshfeld
*Assistant Examiner*—Dave A. Ghatt
(74) *Attorney, Agent, or Firm*—Fitzpatrick, Cella, Harper & Scinto

(57) ABSTRACT

An image forming apparatus which includes: an image forming apparatus main body provided with an image forming portion for forming an image on a sheet; an upstream-side sheet feed unit which is juxtaposed to the image forming apparatus main body and feeds a sheet contained therein to the image forming portion; a sheet treatment portion for treating a sheet fed thereto; and a downstream-side sheet feed unit which is juxtaposed between the image forming apparatus main body and the sheet treatment portion and feeds a sheet contained therein to the sheet treatment portion, in which each of the upstream-side sheet feed unit and the downstream-side sheet feed unit is selectively attachable to the image forming apparatus main body, and the upstream-side sheet feed unit and the downstream-side sheet feed unit have the same construction.

17 Claims, 5 Drawing Sheets

IMAGE FORMING APPARATUS

BACKGROUND OF THE INVENTION

1. Field of the Invention

The present invention relates to an image forming apparatus, in particular an image forming apparatus in which a sheet feed unit is selectively attached to a main body thereof.

2. Related Background Art

Conventionally, examples of image forming apparatuses such as copying machines include those provided with a sheet treatment portion that carries out processes such as bookbinding of sheets. In image forming apparatuses provided with such a sheet treatment portion, there are set modes for performing bookbinding such as a top cover mode and a slip sheet mode. According to those modes, a control is performed so as to insert, for example, sheets contained in a cassette (or sheet feeding trays) provided in an image forming apparatus main body, as a top page (top cover), a last page (back cover), and in-between pages, in addition to sheets on which images have been formed in an image forming portion.

Here, in order to perform bookbinding by using those modes, it is necessary that, other than those sheets on which images are to be formed, top covers, slip sheets, back covers, and insertion sheets are contained in different trays and the order of transport thereof is set such that these sheets including the top covers are subjected to the insertion process at predetermined timings. Note that both the insertion position (place) and the insertion number of the sheets to be inserted at this time can be arbitrarily set.

Then, in the sheet treatment portion, a sheet stack into which the top cover and the like have been thus inserted is subjected to processes such as a stack delivery process, a stitch process, a fold process, and a bookbinding process. Note that an operation mode in which sheets are inserted as a top cover, a slip sheet, and a back cover in this way is herein generically referred to as the "slip sheet mode".

Here, at the timing for insertion, those insertion sheets are sent out from the cassette into the same transport path through which the sheets on which images are to be formed passes. Arranged in a middle of the transport path are the image forming portion and a fixing portion. After passing the image forming portion, the insertion sheets pass through the fixing portion. In this case, if color image printing sheets are used as such insertion sheets, there may be a case where the insertion sheets are subjected to heat and pressure upon passing through the fixing portion, resulting in degraded quality of the printed image.

Further, with the recent proliferation of personal computers, color copy paper/color print paper is increasingly used for the insertion sheets. When such color copy paper is inserted, there may be a case where transport property of a sheet feed mechanism is degraded due to oil or the like deposited on the surface of the color copy paper, resulting in a significant reduction in the reliability of sheet transport.

In view of the above, in order to prevent occurrence of those problems, there are proposed image forming apparatuses in which insertion sheets are fed from the downstream side of an image forming portion. As for the method for feeding the insertion sheets from the downstream side of the image forming portion as described above, there is one in which an insertion sheet feeder is provided in a sheet treatment portion and the insertion sheets are supplied from the insertion sheet feeder. Note that apparatuses of this type are described in Japanese Patent Application Laid-Open Nos. 60-180894, 60-191932, and 60-204564.

In each of the apparatuses described in the above official gazettes, as shown in FIG. 5 for example, insertion sheets are supplied at desired timings from an insertion sheet feeder 900 to a sheet treatment portion 500, to be stacked and contained on an intermediate tray 501 provided inside the sheet treatment portion. In addition, sheets delivered from an image forming apparatus main body 800 are also stacked and contained on the intermediate tray 501. Note that, when such an operation is to be performed, it is necessary to set the insertion sheets in advance in a containing portion 900*a* of the insertion sheet feeder 900, so as to be arranged in page order according to the image content and stacked for the desired number of copy sets.

By the way, the POD (Print-on-Demand) market has been rapidly expanding in recent years. With respect to image forming apparatuses, such rapid expansion of the POD market has created a strong desire for an increase in volume and multi-stage construction of sheet feed trays 802, which are provided to the insertion sheet feeder 900 and to the image forming apparatus main body 800 and contain sheets that are to be fed to an image forming portion 801.

For example, when performing bookbinding, it is necessary to insert preprinted papers, multiple colored papers, tab papers, and the like. However, in the method shown in FIG. 5 in which the conventional insertion sheet feeder 900 is provided in the sheet treatment portion 500, it is difficult to realize multistage construction for the insertion sheet feeder 900. Moreover, the number of the sheet feed trays 802 that can be provided in the image forming apparatus main body 800 was limited.

Accordingly, it is possible to conceive of additionally providing an insertion sheet feeder of a construction capable of containing multiple kinds of sheets as well as a sheet feed unit provided with multiple feed trays. However, with such additional provision of an insertion sheet feeder and a sheet feed unit comes a corresponding increase in the complexity of the overall control and also an increase in cost.

SUMMARY OF THE INVENTION

The present invention has been made in view of the above circumstances. Therefore, an object of the invention is to provide an image forming apparatus which is easy to control and can handle POD (Print-on-Demand) while restraining an increase in cost.

According to one aspect of the present invention, an image forming apparatus includes:

- an image forming apparatus main body provided with an image forming portion for forming an image on a sheet;
- an upstream-side sheet feed unit which is juxtaposed to the image forming apparatus main body and feeds a sheet contained therein to the image forming portion;
- a sheet treatment portion for treating a sheet fed thereto; and
- a downstream-side sheet feed unit which is juxtaposed between the image forming apparatus main body and the sheet treatment portion and feeds a sheet contained therein to the sheet treatment portion,
- in which each of the upstream-side sheet feed unit and the downstream-side sheet feed unit is selectively attachable to the image forming apparatus main body, and the upstream-side sheet feed unit and the downstream-side sheet feed unit have the same construction.

According to another aspect of the invention, an image forming apparatus includes:

an upstream-side sheet feed unit for supplying sheets, an image forming apparatus main body, a downstream-side sheet feed unit, and a sheet treatment portion which are connected in series and arranged in this order from the upstream side of a sheet transport direction; and main transport paths for sheets, which are each provided in the upstream-side sheet feed unit, the image forming apparatus main body, and the downstream-side sheet feed unit and connected to each other on a substantially horizontal plane, in which:

the upstream-side sheet feed unit includes plural sheet feed trays that contain sheets, and transport paths provided between the sheet feed trays and the main transport path;

the downstream-side sheet feed unit includes plural sheet feed trays that contain sheets, and transport paths provided between the sheet feed trays and the main transport path; and the upstream-side sheet feed unit and the downstream-side sheet feed unit have the same construction.

DETAILED DESCRIPTION OF THE PREFERRED EMBODIMENTS

Hereinbelow, embodiments of the present invention will be described in detail with reference to the drawings.

Figure 1:
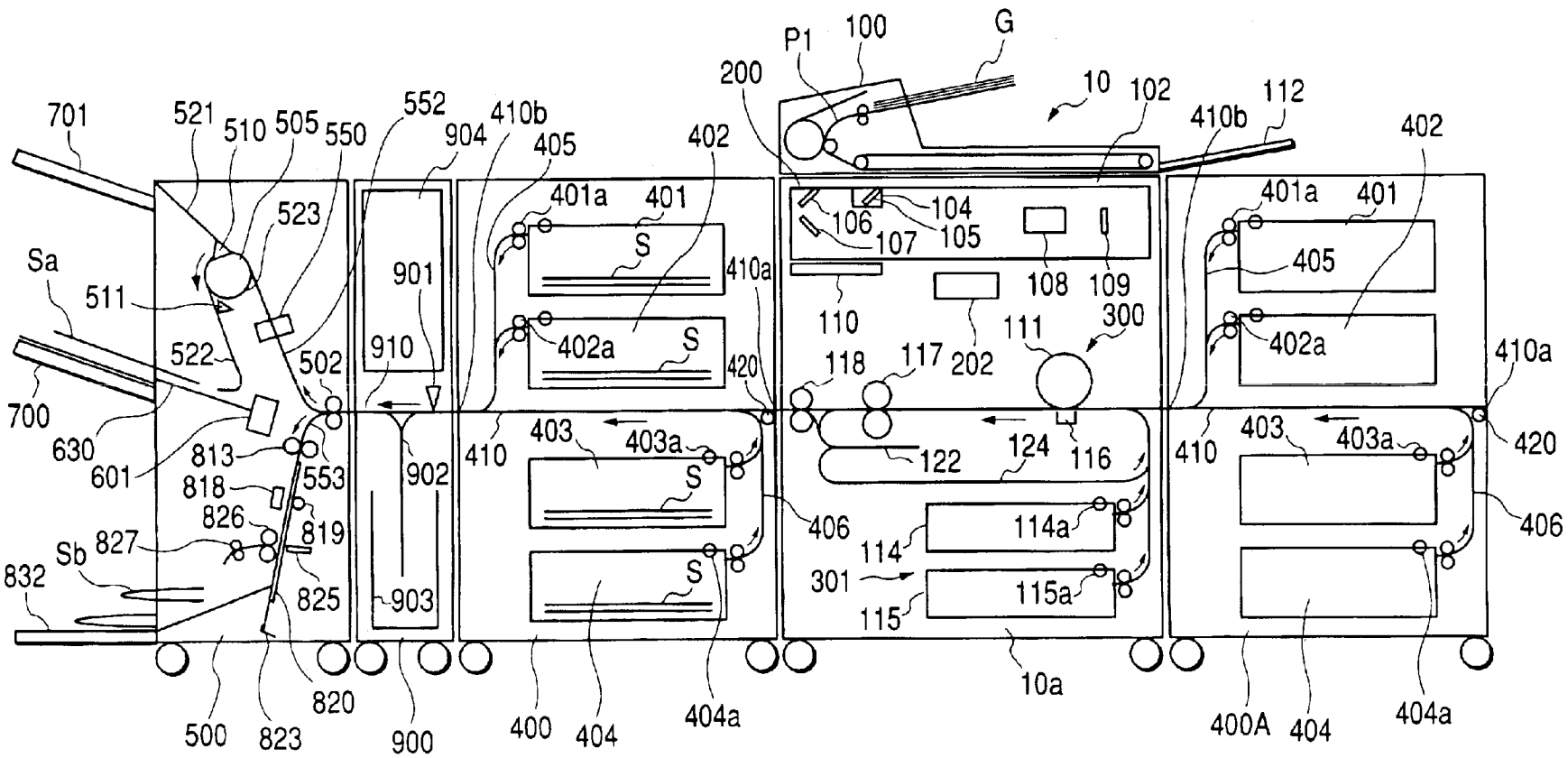
FIG. 1 is a view showing the general construction of an image forming apparatus according to Embodiment 1 of the present invention.

FIG. 1 is a view showing the general construction of an image forming apparatus according to Embodiment 1 of the present invention. In FIG. 1, denoted 10 is the image forming apparatus (copying machine), denoted 10*a* is an image forming apparatus main body, denoted 400 is a multi-inserter which is juxtaposed downstream of the image forming apparatus 10 to constitute a downstream-side sheet feed unit, and denoted 400A is an extension sheet feed deck which is juxtaposed upstream of the image forming apparatus 10 to constitute an upstream-side sheet feed unit. In addition, denoted 500 is a sheet treatment portion arranged downstream of the multi-inserter 400, and denoted 900 is a sheet surface reverse module as sheet surface reverse means arranged between the sheet treatment portion 500 and the multi-inserter 400. The extension sheet feed deck 400A, the image forming apparatus 10, the multi-inserter 400, the sheet surface reverse module 900, and the sheet treatment portion 500 are connected with each other in a state in which they are horizontally juxtaposed to each other.

The image forming apparatus 10 is provided with: an image reader 200 for reading an image of an original (hereinafter referred to as the "original image"); a photosensitive drum 111; an image forming portion 300 including a transferring portion 116, a fixing portion 117, and the like; and a sheet feeding apparatus 301 that feeds sheets contained in cassettes 114 and 115 to the image forming portion 300.

(Image Forming Apparatus: Image Reader)

The image reader 200 is provided with an auto original feeder 100 which feeds originals G sequentially one by one from the top page of the originals G, which are set on an original tray (not shown) so as to face upward, transports the originals on a platen glass plate 102 from left to right through a curved path P1, and thereafter delivers them toward an external sheet delivery tray 112.

Then, as the original G is fed by the auto original feeder 100 from left to right on the platen glass plate 102, the original image is read by a scanner unit 104 fixedly held in a predetermined position.

Note that this method of reading an original image is generally called as flow-reading. In the case of such flow-reading, when the original G passes through a predetermined flow-reading position, a reading surface of the original G is irradiated with the light of a lamp of the scanner unit 104, and light reflected by the original G is guided to a lens 108 via mirrors 105, 106, and 107. Further, the light having passed through the lens 108 is imaged on an image pick-up surface of an image sensor 109.

Then, by transporting the original G such that it passes through the flow-reading position from left to right, an original reading scan is performed with a direction orthogonal to the transport direction of the original G as a main scanning direction, and with the original transport direction as a sub-scanning direction. That is, reading of the entire original image is performed by transporting the original G in the sub-scanning direction while reading the original image in the main scanning direction by one line at a time by the image sensor 109 as the original G passes through the flow-reading position.

Then, the image that has been optically read out in this way is converted into image data by the image sensor 109, and the image data is inputted as a video signal in an exposure control portion 110 of the image forming portion 300 after being subjected to predetermined processes in an image signal control portion 202.

Note that, as the method of reading an original image by the image reader 200, in addition to the flow-reading method described above, there is also a method called original fixed-reading in which the original G is stopped on the platen glass plate 102 after being transported thereto by the auto original feeder 100, and the original is read by scanning it from left to right with the scanner 104 in this state.

Further, when reading an original without using the auto original feeder 100, the auto original feeder 100 is lifted to place the original on the platen glass plate 102, and then reading of the original is performed by scanning it from left to right with the scanner 104.

(Image Forming Apparatus: Image Forming Portion)

Next, when the video signal is inputted as described above, the exposure control portion 110 of the image forming portion 300 outputs laser beam after modulating it on the basis of the inputted video signal. Then, the laser beam is irradiated on the photosensitive drum 111 while being scanned by a polygon mirror (not shown), so that an electrostatic latent image corresponding to the scanned laser beam is formed on the photosensitive drum 111. Note that, at the time of the original fixed-reading, the exposure control portion 110 outputs laser beam such that a correct image (an image that is not a mirror image) is formed.

Then, the electrostatic latent image thus formed on the photosensitive drum 111 is rendered visible as a developer image with a developer supplied from a developing device (not shown). Note that a sheet is fed at a timing synchronous with commencement of the laser beam irradiation, and the sheet is transported to be positioned between the photosensitive drum 111 and the transferring portion 116. Then, as the sheet passes between the photosensitive drum 111 and the transferring portion 116, the developer image formed on the photosensitive drum 111 is transferred onto the sheet by the transferring portion 116.

Next, the sheet onto which the developer image has been thus transferred is transported to the fixing portion 117, and the developer image is fixed onto the sheet in the fixing portion 117 by heat and pressure. Then, the sheet having the developer image thus fixed thereon is thereafter delivered from the image forming portion 300 toward the multi-inserter 400 via a flapper (not shown) and a delivery roller 118.

Note that, when delivering a sheet with its image forming surface facing down (facedown), a sheet that has passed through the fixing portion 117 is once guided into a sheet surface reverse path 122 by switching operation of a flapper (not shown). Then, after a trailing edge of the sheet passes through the flapper, the sheet is switched back so as to be delivered from the image forming portion 300 by the delivery roller 118.

Here, such sheet surface reverse delivery is performed when image formation is conducted sequentially from the top page of the originals, such as when forming an image read out by using the auto original feeder 100 or when forming an image outputted from a computer. As a result, the sheets are arranged in the correct page order after the delivery.

Further, when two-side recording mode for forming images on two sides of a sheet is set, a control is performed such that, after guiding the sheet into the sheet surface reverse path 122 by switching operation of the flapper (not shown), the sheet is transported to a duplex transport path 124, and then the sheet thus transported to the duplex transport path 124 is re-transported to a position between the photosensitive drum 111 and the transferring portion 116 at a timing described above.

(Image Forming Apparatus: Sheet Feeding Apparatus)

Disposed below the image forming portion 300 is the sheet feeding apparatus 301. The sheet feeding apparatus 301 is provided with the sheet feed cassettes 114 and 115 containing sheets to be supplied to the image forming portion 300, and sheet feed portions 114*a* and 115*a* for feeding the sheets one by one from the sheet feed cassettes 114 and 115 after separating them into single sheets.

Sheets are sent out from the sheet feed cassettes 114 and 115 according to the timing of image formation by the image forming portion 300, thereby forming images on the sheets.

(Multi-Inserter)

The multi-inserter 400 to be connected to the image forming apparatus main body 10*a* is provided with an insert function for feeding special sheets such as the top page and the last page of a sheet stack, and a top cover and a slip sheet to be inserted into the sheet stack having images formed thereon. The multi-inserter 400 includes sheet feed trays 401 to 404 which are provided in a vertical direction and serve as plural large-volume sheet containing portions that can be drawn forward of the apparatus, and a main transport path 410 which is provided in a central portion of the multi-inserter main body 400A and serves as a transport path arranged on a substantially horizontal plane for receiving sheets delivered from the image forming apparatus 10 and transporting them to the sheet surface reverse module 900 and the sheet treatment portion 500 provided on the downstream side thereof. In the main transport path 410, a sheet inlet 410*a* and a sheet outlet 410*b* are formed on the side for receiving sheets and on the side for delivering the sheets, respectively, on side surfaces opposed to the image forming apparatus main body 10*a*.

The sheet feed trays 401 to 404 each contain sheets S that serve as top covers and slip sheets. The multi-inserter 400 is adapted to sequentially transport those sheets S, which serve as the top covers and the slip sheets, to the sheet surface reverse module 900 or the sheet treatment portion 500 through the main transport path 410.

Note that in this embodiment, the sheets S contained in the sheet feed trays 401 and 402 provided above the main transport path 410 are fed leftward as seen in FIG. 1 by sheet feed and separation portions 401*a* and 402*a* serving as sheet feed portions, to join the main transport path 410 after passing through a vertical transport path 405. Also, the sheets S contained in the sheet feed trays 403 and 404 provided below the main transport path 410 are fed rightward as seen in FIG. 1 by sheet feed and separation portions 403*a* and 404*a* serving as sheet feed portions, to join the main transport path 410 after passing through a vertical transport path 406.

The sheets S contained in those sheet feed trays 401 to 404 are a variety of special sheets such as colored papers, front covers, and color preprinted papers which are required in the POD market. For example, when setting color preprinted papers as such special sheets, preprinted papers that are desired to be inserted are stacked on the sheet feed trays 401 to 404 with their surfaces facing upward (in a face-up state). Note that, by thus setting the preprinted papers in the face-up state, it is possible to attain improved operability by the user and improved alignment property between the order of stacking and the order of output.

Note that the preprinted papers (the sheets S) thus set on the sheet feed trays 401 to 404 are transported after being sequentially separated into single sheets from the uppermost sheet thereof by the sheet feed and separation portions 401*a* to 404*a*. Then, preprinted papers transported in this way are thereafter guided into the vertical transport path 405, 406 by a draw roller pair (not shown) disposed on the downstream side of each of the sheet feed and separation portions 401*a* to 404*a*.

(Sheet Treatment Portion)

The sheet treatment portion 500 performs a variety of processes including: a process in which sheets from the image forming apparatus 10 delivered through the main transport path 410 of the multi-inserter 400 or insert sheets from the multi-inserter 400 are sequentially taken in and the plural sheets thus taken in are aligned and bound into a single sheet stack; a staple process in which the trailing edge of the jogged sheet stack is stitched with staples; a punch process in which holes are cut near the trailing edges of the taken-in sheets; a sort process; a non-sort process; and a bookbinding process.

Here, the sheet treatment portion 500 includes an entrance roller pair 502 for guiding sheets transported via the image forming apparatus 10 or the multi-inserter 400 into the inside thereof. Provided downstream of the entrance roller pair 502 is a switching flapper (not shown) for guiding the sheets to a processing path 552 or a bookbinding path 553.

Then, the sheets guided to the processing path 552 by the switching flapper are sent toward a buffer roller 505 by a transport roller pair (not shown). Here, the buffer roller 505 is a roller capable of laminating and winding on its outer periphery a predetermined number of sheets that are sent thereto. Sheets are wound around an outer periphery of the roller 505 by plural push down rollers (not shown) as occasion demands, and the sheets thus wound up thereon are transported by rotation of the buffer roller 505.

In addition, disposed near the transport path on the outer periphery of the buffer roller 505 are switching flappers 510 and 511. Here, the switching flapper 510 on the upstream side is a flapper for stripping from the buffer roller 505 the sheets wound around the buffer roller 505 and guiding them to a non-sort path 521 or a sort path 522. The switching flapper 511 on the downstream side is a flapper for stripping from the buffer roller 505 the sheets wound around the buffer roller 505 and guiding them to the sort path 522, or for guiding the sheets to a buffer path 523 in the state where they are being wound around the buffer roller 505.

Sheets guided to the non-sort path 521 by the switching flapper 510 on the upstream side are delivered onto a sample tray 701 via a delivery roller pair (not shown). Note that, a sheet delivery sensor (not shown) for detecting paper jam and the like is provided in a middle of the non-sort path 521.

Also, sheets guided to the sort path 522 by the switching flapper 510 on the upstream side are stacked onto an intermediate tray 630 by a transport roller (not shown). Then, after being subjected to an alignment process, a staple process in which the sheets stacked in a bundle on the intermediate tray 630 are stitched together with a stapler 601, and the like as occasion demands, the sheets are delivered as a sheet stack Sa by a delivery roller (not shown) onto a stack tray 700 that is capable of self-advancing in a vertical direction.

Note that a punch unit 550 is provided between the transport roller pair and the buffer roller 505. Punch holes can be cut near the trailing edges of the transported sheets by operating the punch unit 550 as occasion demands.

Also, a sheet guided to the bookbinding path 553 by a switching flapper (not shown) provided downstream of the entrance roller pair 502 is first contained into a containing guide 820 by a transport roller pair 813, and is further transported until the leading edge of the sheet comes into contact with a movable sheet positioning member 823.

Here, a bookbinding entrance sensor (not shown) is disposed on the upstream side of the transport roller pair 813. Further, two staplers 818 are provided in a middle of the containing guide 820. The staplers 818 are adapted to stitch the center of a sheet stack in cooperation with an anvil 819 opposed thereto.

Further, a fold roller pair 826 is provided on the downstream position of the staplers 818, and a stick-out member 825 is provided in a position opposing the fold roller pair 826. Then, by sticking out the stick-out member 825 toward a sheet stack Sb contained in the containing guide 820, the sheet stack Sb is pushed out to the position of the fold roller pair 826 to be folded thereby, and is thereafter delivered onto a saddle delivery tray 832 through a folded sheet delivery roller 827. Note that, when folding the sheet stack Sb that has been stitched by the staplers 818, the sheet positioning member 823 is moved down by a predetermined distance so that the stapled position of the sheet stack Sb coincides with the center position of the fold roller pair 826 after finishing the staple process.

(Sheet Surface Reverse Module)

The sheet surface reverse module 900 is disposed between the multi-inserter 400 and the sheet treatment portion 500 and provided with a substantially horizontal path 910 and a sheet surface reverse path 902. Here, the substantially horizontal path 910 is a path which is connected to the sheet outlet 410*b* of the main transport path 410 of the multi-inserter 400 to transport sheets toward the entrance roller pair 502 of the sheet treatment portion 500. The sheet surface reverse path 902 is a path branching out from the substantially horizontal path 910 to extend in a substantially vertical direction. Note that the respective transport paths of the extension sheet feed deck 400A, the image forming apparatus 10, the multi-inserter 400, and the sheet surface reverse module 900 are arranged on the same substantially horizontal plane.

Upon passing through the substantially horizontal path 910, the sheet S fed from the multi-inserter 400 is selectively transported by switching operation of a switching flapper (not shown) to the sheet surface reverse path 902 to have its surface reversed therein.

Note that, by thus using the sheet surface reverse module 900 to reverse the surface of the sheet S fed from the multi-inserter 400, the multi-inserter 400 can be made compact and, as to be described later, it becomes possible to achieve commonality between the multi-inserter 400 and the extension sheet feed deck 400A. Further, by making the sheet surface reverse path 902 of the sheet surface reverse module 900 substantially vertical, it is possible to achieve a reduction in space of the overall system.

Next, a description will be made of the sheet surface reverse operation of the sheet surface reverse module 900 constructed as described above.

As has been described above, the preprinted papers contained in the sheet feed trays 401 and 402 of the multi-inserter 400 are fed to the left and transported to the main transport path 410 via the vertical transport path 405 while maintaining the face-up state. Also, the preprinted papers contained in the sheet feed trays 403 and 404 are fed to the right and, after passing through the vertical transport path 406, they are subjected to a U-turn, that is, rendered in their facedown states, before being transported to the main transport path 410.

On the other hand, when the sort process, the staple process, and the like are to be performed in the sheet treatment portion 500, it is necessary that preprinted papers be transported facedown to the processing path 552. In addition, when saddle stitching bookbinding is to be performed, it is necessary that the preprinted papers are transported face-up to the bookbinding path 553.

Figure 2:
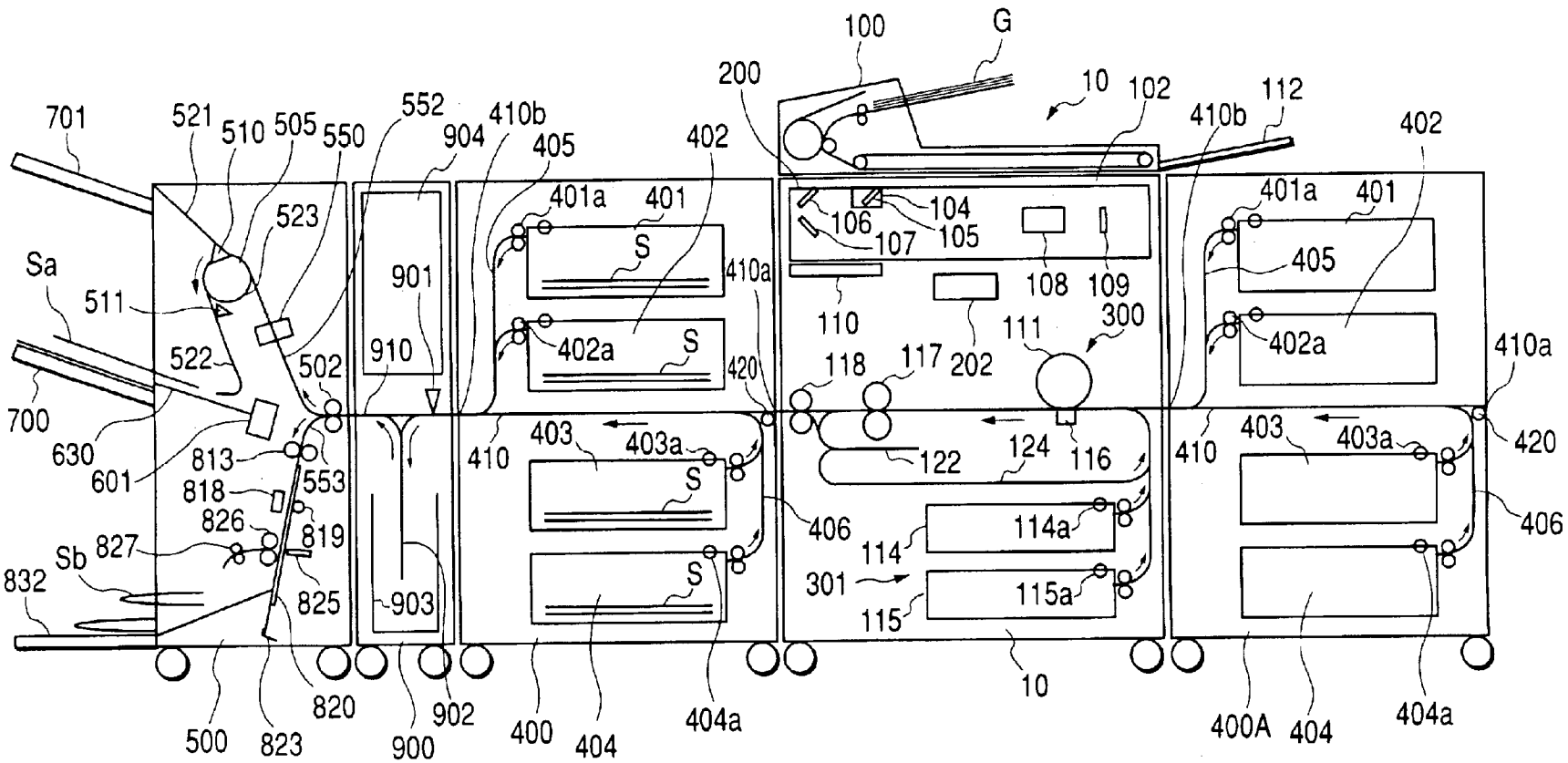
FIG. 2 is a view for explaining a sheet surface reverse operation of a sheet surface reverse module provided to the image forming apparatus.

Accordingly, when performing staple process or the like, for example when performing a job of obtaining a mixed stapled output of a print output paper from the image forming apparatus 10 and a color preprinted paper from the multi-inserter 400, in order for the color preprinted paper to be transported facedown to the processing path 552, upon feeding from the sheet feed trays 401 and 402, the color preprinted papers are subjected to the sheet surface reverse operation in the sheet surface reverse path 902 as indicated by the arrows in FIG. 2, thereby sending them facedown. Note that, when using the color preprinted papers contained in the sheet feed trays 403 and 404, the color preprinted papers are sent without passing though the sheet surface reverse path 902.

When saddle stitching bookbinding is to be performed, it is necessary that sheets are sent face-up to the bookbinding path 553. Accordingly, upon feeding from the sheet feed trays 403 and 404, color preprinted papers are sent facedown after having their surfaces reversed in the sheet surface reverse path 902 as indicated by the arrows in FIG. 2. Note that, when using color preprinted papers contained in the sheet feed trays 401 and 402, the color preprinted papers are sent without passing though the sheet surface reverse path 902.

In this embodiment, an irregularity detection sensor 901 is disposed near the entrance of the substantially horizontal path 910, as detection means for detecting deformation of sheets fed from the multiple inserter 400 such as double feeding, corner bending, and the like, to detect such double-fed and deformed irregular sheets before the sheets are sent to the sheet treatment portion 500. Further, below the sheet surface reverse path 902, an irregular sheet receiving tray 903 for receiving such irregular sheets is provided such that it can be drawn forward of the apparatus.

By thus detecting irregular sheets by the irregularity detection sensor 901 and delivering the detected irregular sheets onto the irregular sheet receiving tray 903, it is possible to prevent unnecessary processings from being performed by the sheet treatment portion 500.

Further, since the irregular sheet receiving tray 903 is provided inside the sheet surface reverse module 900 below the sheet surface reverse path 902, saving of space can be achieved. In addition, it becomes unnecessary to provide a sheet surface reverse mechanism that is conventionally required to be provided in the sheet treatment portion 500, making it possible to significantly simplify the construction of the sheet treatment portion 500.

Further, a multi-containing portion 904 serving as a containing portion is provided above the sheet surface reverse module 900. By providing the multi-containing portion 904 described above, it is possible to prevent a concave portion from being formed between the multi-inserter 400 and the sheet treatment portion 500, and consumables such as toner, tools, and the like can be contained in the multi-containing portion 904, thereby achieving improved user convenience.

Further, by thus preventing a concave portion from being formed between the multi-inserter 400 and the sheet treatment portion 500, the height of the overall apparatus system, that is, the respective top surface heights of the extension sheet feed deck 400A, the image forming apparatus main body 10*a*, the multi-inserter 400, the multi-containing portion 904, and the sheet treatment portion 500 can be made substantially uniform. As a result, enhanced design of the image forming apparatus 10 can be achieved.

(Extension Sheet Feed Deck)

The extension sheet feed deck 400A is connected and juxtaposed to the upstream side of the image forming apparatus 10, and its construction is the same as that of the multi-inserter 400. That is, the extension sheet feed deck 400A includes: plural large-volume sheet feed trays 401 to 404 provided in a vertical direction and serving as sheet containing portions; sheet feed and separation portions 401*a* to 404*a* serving as sheet feed portions for sending sheets from the sheet feed trays 401 to 404; and a substantially horizontal main transport path 410 provided in a central portion thereof, for receiving the sheets fed from the sheet feed trays 401 to 404 to transport them to the image forming apparatus 10 on the downstream side thereof.

Further, in the extension sheet feed deck 400A, a manual feed portion (not shown) for feeding hard sheets such as OHP sheets is optionally attached to a sheet inlet 410*a*. A hard sheet is fed from the manual feed portion, and when an image is to be formed on this sheet, the sheet is delivered by the delivery roller 118 with its image forming surface facing upward (in the face-up state), without being guided to the sheet surface reverse path 122. Note that, in FIG. 1, reference numeral 420 denotes a transport roller for transporting sheets set on the manual feed portion. This transport roller 420 is also provided in the multi-inserter 400.

In this case, by thus providing the extension sheet feed deck 400A that includes the large-volume sheet feed trays 401 to 404, it is possible to handle an increase in the kinds and feed volume of sheets to be printed in the image forming portion 300.

For example, extremely thick papers such as those having basic weights exceeding 300 g/m$^2$ are contained in the sheet feed trays 401 and 402 from which sheets are sent out through the vertical transport path 405 that is not a U-turn path. Note that this also applies to the multi-inserter 400.

(Operation)

In the image forming apparatus constructed as described above, a sheet stack to be prepared and sheets of the size and kind used for a book are set in advance on the sheet feed cassettes 114 and 115, and on the respective sheet feed trays 401 to 404 of the extension sheet feed deck 400A. Likewise, top covers, slip sheets, and color copied sheets are set on the respective sheet feed trays 401 to 404 of the multi-inserter 400.

Then, on the basis of information on an original read by the image reader 200 and information sent via a network, image formation is performed in the image forming portion 300. Sheets on which images are to be formed are supplied as appropriate from the sheet feed cassettes 114 and 115, and the respective sheet feed trays 401 to 404 of the extension sheet feed deck 400A. The sheets having images formed thereon are sent to the sheet treatment portion 500 after first passing through the main transport path 410 of the multi-inserter 400 and then further passing through the sheet surface reverse module 900. In addition, top covers, slip sheets, and color copied sheets are supplied as appropriate from the multi-inserter 400 so as to be inserted in between the sheets on which images have been formed. Note that, since processes to be performed in the sheet surface reverse module 900 and the sheet treatment portion 500 are as described hereinbefore, a description thereof is omitted.

In the foregoing, an embodiment of the present invention has been described in detail. As described above, the extension sheet feed deck 400A provided with the large-volume sheet feed trays 401 to 404, and the multi-inserter 400 are juxtaposed upstream and downstream of the image forming apparatus main body 10*a*, respectively, thereby making it possible to handle a variety of sheets required in the POD market and prevent system interruption from occurring when adding sheets.

Further, a reduction in cost can be achieved when commonality is established between the extension sheet feed deck 400A and the multi-inserter 400. Note that the sheet feed operations of the multi-inserter 400 and the extension sheet feed deck 400A are controlled by a control portion (not shown). In this case, the control is facilitated by establishing complete commonality between the multi-inserter 400 and the extension sheet feed deck 400A. In addition, extension of additional units is also facilitated, thereby enhancing the expandability of the image forming apparatus as a whole.

As described above, the extension sheet feed deck 400A is provided on the upstream side of the image forming apparatus main body 10*a* and the multi-inserter 400 is provided on the downstream side of the image forming apparatus main body 10*a*, and further, the extension sheet feed deck 400A and the multi-inserter 400 which have the same construction are used, whereby the image forming apparatus can handle POD (Print-on-Demand) by easy control while restraining an increase in cost.

(Embodiment 2)

Next, Embodiment 2 of the present invention will be described.

Figure 3:
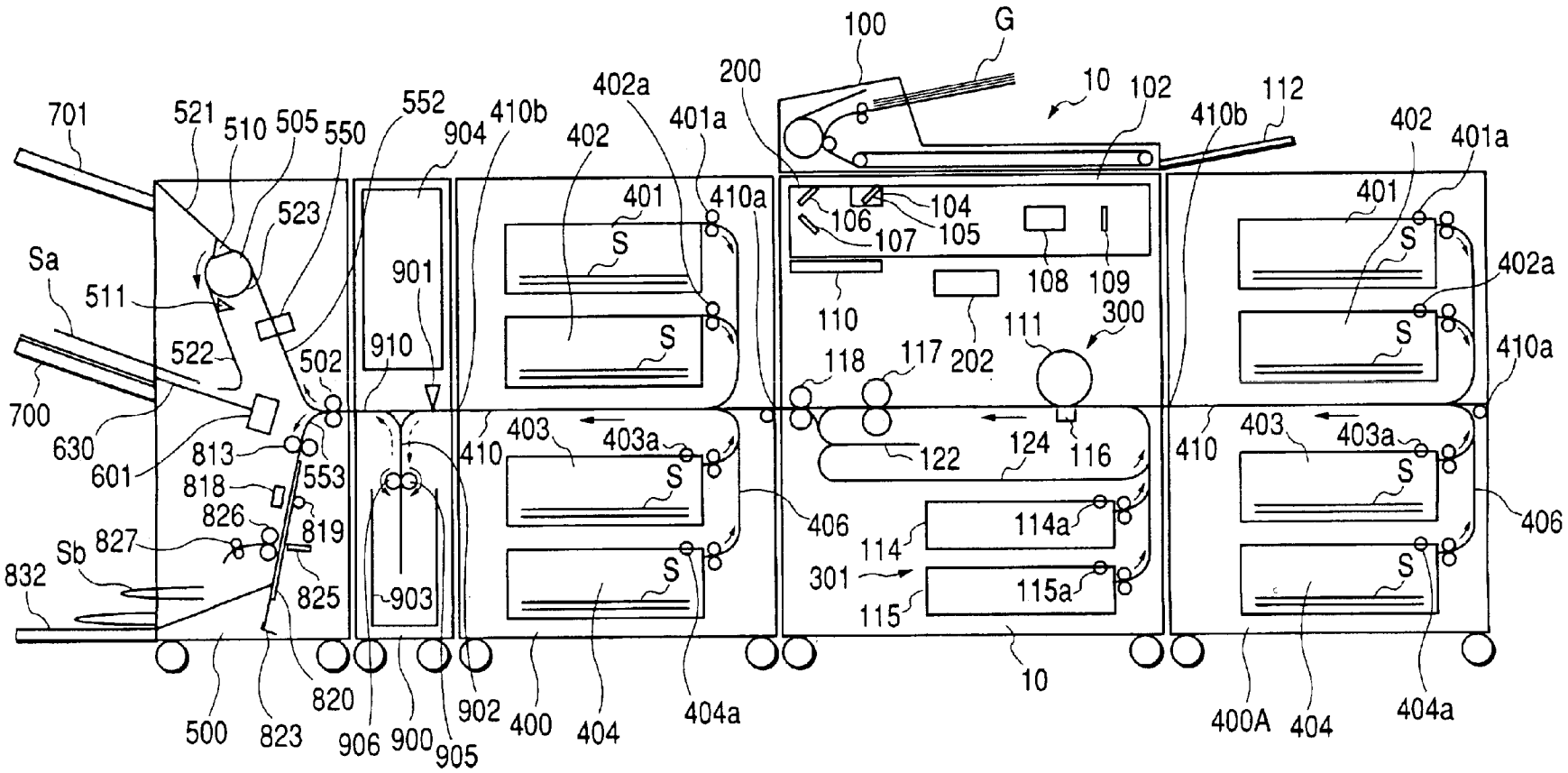
FIG. 3 is a view showing the general construction of an image forming apparatus according to Embodiment 2 of the present invention.

FIG. 3 is a view showing the general construction of an image forming apparatus according to this embodiment.

Note that, in FIG. 3, reference numerals and symbols that are the same as those of FIG. 1 of Embodiment 1 refer to like or equivalent portions, and therefore a detailed description thereof will be omitted.

In this embodiment, as shown in FIG. 3, the sending direction of the sheets contained in the respective sheet feed trays 401 to 403 of the multi-inserter 400 and the extension sheet feed deck 400A is made uniform as the rightward direction. Note that the bookbinding operation in this embodiment is substantially the same as that described in Embodiment 1.

With such an arrangement, the vertical transport paths 405 and 406 can be arranged concentratedly on the right hand sides in the apparatus, making it possible to reduce the installation spaces occupied by the multi-inserter 400 and the extension sheet feed deck 400A while maintaining commonality between the multi-inserter 400 and the extension sheet feed deck 400A.

Further, in this embodiment, commonality is established between the sheet feed portions 114*a* and 115*a* inside the image forming apparatus main body and the sheet feed portions 401*a* to 404*a* of the multi-inserter 400, thus promoting a reduction in cost.

In this embodiment, the sheet surface reverse path 902 is provided with re-separation means which is composed of, for example, a re-feed roller 905 that rotates only in the direction indicated by the arrow due to an action of a one way clutch (not shown), and a re-retard roller 906 provided with a torque limiter mechanism (not shown) in an axial direction.

Since the sending direction of sheets S to be sent out from the respective sheet feed trays 401 to 404 of the multi-inserter 400 is the rightward direction, the sheets S are transported facedown in the main transport path 410. Thus, when a determination of a double feed is made by the irregularity detection sensor 901, the double-fed sheets are transported, by the re-retard roller 906 that rotates in the direction indicated by the arrow, to below the sheet surface reverse path 902 in such a positional relationship that the sheet on the right side becomes the upper sheet.

In this case, when thus transported in such a positional relationship that the sheet on the right side becomes the upper sheet, the sheets are then fed after being separated into single sheets by the re-feed roller 905 and the re-retard roller 906 which begin to rotate in the directions indicated by the arrows, thus making it possible to prevent wasteful use of sheets while securing productivity. Further, by setting the double-feed prevention capability of the re-separation unit to be higher than those of the sheet feed portions of the multi-inserter 400, occurrence of a double-feed can be reduced with higher level of reliability.

Note that, while the foregoing description is directed to the case where the sending directions of sheets contained in the respective sheet feed trays 401 to 404 of the multi-inserter 400 and the extension sheet feed deck 400A are all made uniform as the rightward direction, the same effects can be attained when the sheet sending directions are made uniform as the leftward direction.

In this case, the sheets to be transported from the respective sheet delivery trays 401 to 404 of the multi-inserter 400 are transported face-up in the main transport path 410. Accordingly, the sheets are transported to the sheet surface reverse path 902 in such a positional relationship that the sheet on the left side becomes the upper sheet. Therefore, the positional relationship between the re-feed roller 905 and the re-retard roller 906 becomes the opposite of that shown in FIG. 3.

(Embodiment 3)

Figure 4:
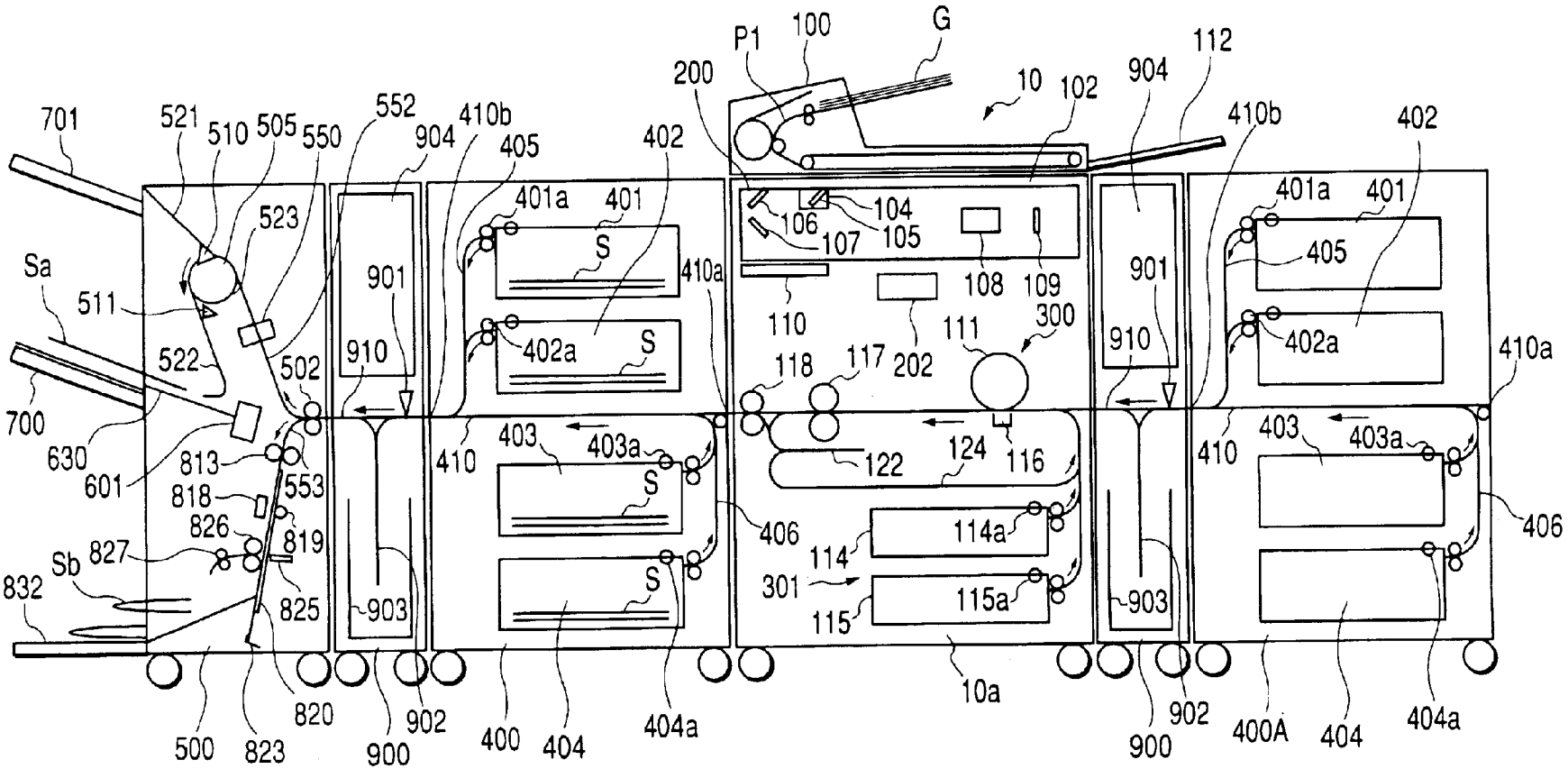
FIG. 4 is a view showing the general construction of an image forming apparatus according to Embodiment 3 of the present invention.
Figure 5:
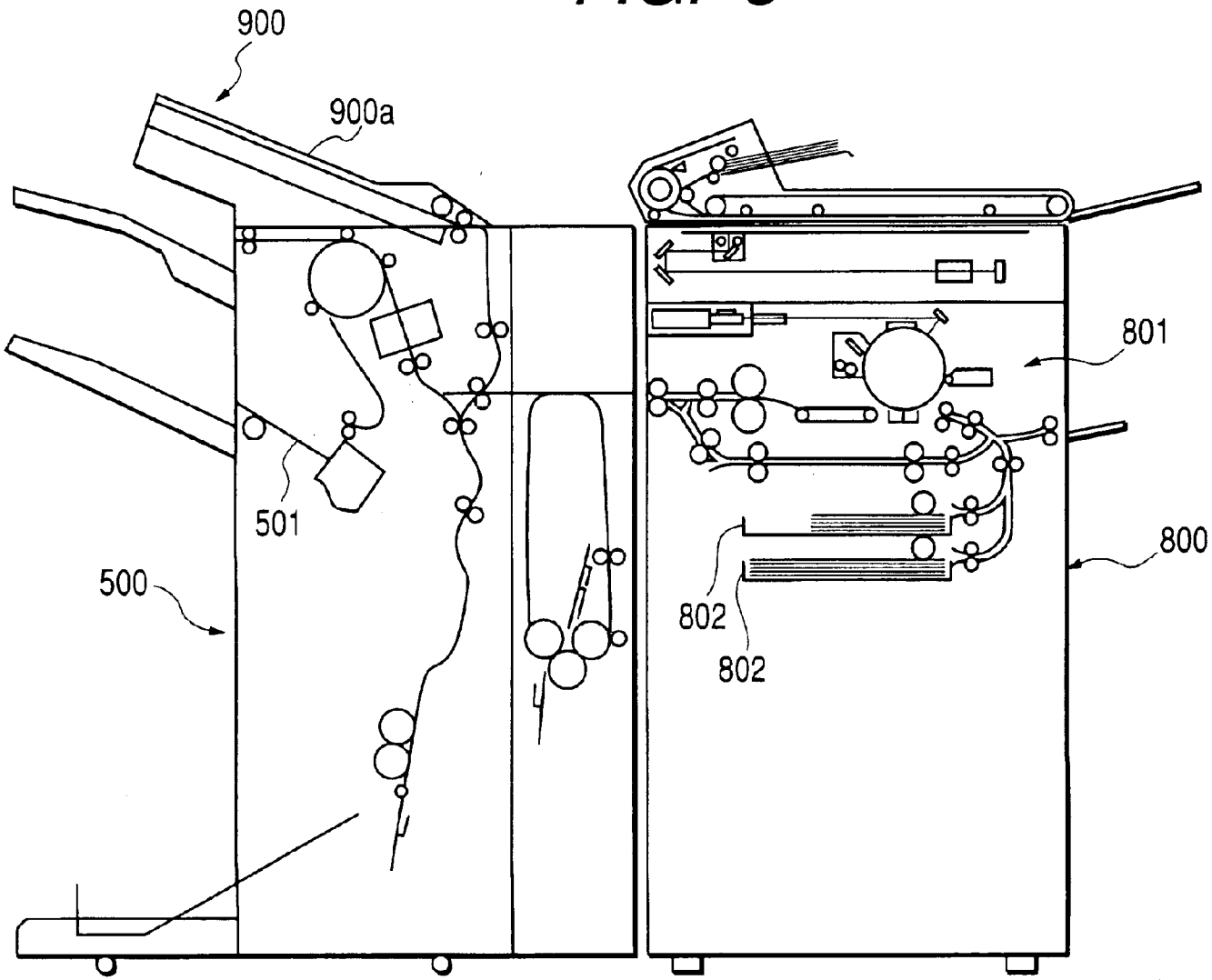
FIG. 5 is a view showing the construction of a conventional image forming apparatus.

Next, Embodiment 3 of the present invention will be described using FIG. 4. Note that, in FIG. 4, the same reference numerals and symbols as used in FIG. 1 denote like or equivalent portions.

In this embodiment, the sheet surface reverse module 900 is arranged also on the downstream side of the extension sheet feed deck 400A. By arranging the sheet surface reverse module 900 as described above, it is possible to avoid a problem in which irregular sheets are sent into the image forming portion, thereby further increasing productivity.

By the way, while the image forming portion 300 described in each of Embodiments 1 to 3 is a black-and-white copying machine for forming black-and-white images, it may also be a color copying machine capable of forming color images. Further, since the multi-inserter 400 and the extension sheet feed deck 400A can be connected to each other, two or three or more units thereof may be connected together taking into consideration the intended output job and the installation space available.

Note that, while the foregoing is directed to the case where the extension sheet feed deck 400A is provided on the upstream side of the image forming portion 300 and the multi-inserter 400 is provided on the downstream side of the image forming portion, depending on the output job, a construction may be adopted in which only one of the extension sheet feed deck 400A and the multi-inserter 400 is selectively provided.

As has been described above, according to the present invention, the sheet feed unit is provided selectively on each of the upstream and downstream sides of the image forming apparatus main body, and the construction of the sheet feed unit on the upstream side and that of the sheet feed unit on the downstream side are made the same, whereby the image forming apparatus can handle POD (Print-on-Demand) by easy control while restraining an increase in cost.

What is claimed is:

1. An image forming apparatus comprising:

an image forming apparatus main body provided with an image forming portion for forming an image on a sheet;

an upstream-side sheet feed unit which is juxtaposed to the image forming apparatus main body and feeds a sheet contained therein to the image forming portion;

a sheet treatment portion for treating a sheet fed thereto; and a downstream-side sheet feed unit which is juxtaposed between the image forming apparatus main body and the sheet treatment portion and feeds a sheet contained therein to the sheet treatment portion, wherein each of the upstream-side sheet feed unit and the downstream-side sheet feed unit is selectively attachable to the image forming apparatus main body, and the upstream-side sheet feed unit has the same construction as the downstream-side sheet feed unit.

2. An image forming apparatus according to claim 1, wherein each of the upstream-side sheet feed unit and the downstream-side sheet feed unit is provided with:

sheet containing portions that contain sheets;

sheet feed portions that feed the sheets contained in the sheet containing portions; and a transport path for transporting toward the downstream the sheets that are sent out from the sheet containing portions by the sheet feed portions.

3. An image forming apparatus according to claim 2, wherein the transport path in each of the upstream-side sheet feed unit and the downstream-side sheet feed unit is arranged on a substantially horizontal plane, and the respective sheet containing portions are provided vertically across the transport path.

4. An image forming apparatus according to claim 3, wherein the respective sheet feed portions are arranged such that sheets are sent out in one direction from the sheet containing portions provided vertically across the sheet transport path.

5. An image forming apparatus according to claim 3, wherein, in the sheet containing portions provided vertically across the transport path, a direction in which sheets are sent out from the sheet containing portion arranged above the transport path is opposite to a direction in which sheets are sent out from the sheet containing portion arranged below the transport path.

6. An image forming apparatus according to claim 2, wherein the image forming apparatus main body is provided with:

sheet containing portions that contain sheets to be supplied to the image forming portion; and sheet feed portions that feed the sheets from the sheet containing portions, wherein the sheet feed portions have the same construction as the sheet feed portions of the upstream-side sheet feed unit and the downstream-side sheet feed unit.

7. An image forming apparatus according to claim 2, wherein the downstream-side sheet feed unit has an inserter function for inserting a sheet in between sheets sent out from the image forming portion.

8. An image forming apparatus according to claim 2, wherein a manual feed portion is provided on the upstream side of the transport path of the upstream-side sheet feed unit.

9. An image forming apparatus according to claim 1, wherein a plurality of the upstream-side sheet feed units and a plurality of the downstream-side sheet feed units can be connected.

10. An image forming apparatus according to claim 1, comprising sheet surface reverse means, provided between the downstream-side sheet feed unit and the sheet treatment portion, for selectively reversing a front surface and a back surface of a sheet sent from one of the image forming apparatus main body and the downstream-side sheet feed unit.

11. An image forming apparatus according to claim 10, wherein the sheet surface reverse means is configured as a unit.

12. An image forming apparatus according to claim 10, wherein the sheet surface reverse means is provided with a sheet surface reverse transport path for reversing the front surface and the back surface of the sheet, the sheet surface reverse transport path being disposed in a substantially vertical direction.

13. An image forming apparatus according to claim 10, wherein the sheet surface reverse means is provided with detection means for detecting a double feed or deformation of the sheets.

14. An image forming apparatus according to claim 1, comprising sheet surface reverse means, provided between the upstream-side sheet feed unit and the image forming apparatus main body, for selectively reversing a front surface and a back surface of a sheet from the upstream-side sheet feed unit.

15. An image forming apparatus according to claim 1, wherein respective top surface heights of the upstream-side sheet feed unit, the image forming apparatus main body, the downstream-side sheet feed unit, and the sheet treatment portion are substantially the same.

16. An image forming apparatus comprising:

an upstream-side sheet feed unit for supplying sheets, an image forming apparatus main body, a downstream-side sheet feed unit, and a sheet treatment portion, which are connected in series and arranged in this order from the upstream side of a sheet transport direction; and main transport paths for sheets, which are each provided in the upstream-side sheet feed unit, the image forming apparatus main body, and the downstream-side sheet feed unit and connected to each other on a substantially horizontal plane, wherein the upstream-side sheet feed unit includes plural sheet feed trays that contain sheets, and transport paths provided between the sheet feed trays and the main transport path, wherein the downstream-side sheet feed unit includes plural sheet feed trays that contain sheets, and transport paths provided between the sheet feed trays and the main transport path, and wherein the upstream-side sheet feed unit has the same construction as the downstream-side sheet feed unit.

17. An image forming apparatus according to claim 16, wherein a plurality of the upstream-side sheet feed units and a plurality of the downstream-side sheet feed units can be connected.

* * * * *

UNITED STATES PATENT AND TRADEMARK OFFICE

CERTIFICATE OF CORRECTION

PATENT NO. : 6,823,154 B2
DATED : November 23, 2004
INVENTOR(S) : Hiroto Koga et al.

It is certified that error appears in the above-identified patent and that said Letters Patent is hereby corrected as shown below:

Column 8,
Lines 56 and 66, “though” should read -- through --.

Signed and Sealed this

Fifth Day of April, 2005

JON W. DUDAS
*Director of the United States Patent and Trademark Office*